US005582347A

United States Patent [19]

Knobbe et al.

[11] Patent Number: 5,582,347

[45] Date of Patent: Dec. 10, 1996

[54] PARTICLE SPRAY APPARATUS AND METHOD

[75] Inventors: Alan J. Knobbe, Amherst; Terrence M. Fulkerson, Parma; Curtis B. Haller, Lorain; John B. Wolanin, Strongsville, all of Ohio

[73] Assignee: Nordson Corporation, Westlake, Ohio

[21] Appl. No.: 320,948

[22] Filed: Oct. 11, 1994

[51] Int. Cl.[6] ..... B05B 5/03

[52] U.S. Cl. ..... 239/3; 239/105; 239/698; 239/705; 239/707

[58] Field of Search ..... 239/697, 698, 239/705–708, 498, 523, 524, 3, 105

[56] References Cited

U.S. PATENT DOCUMENTS

| | | | |
|---|---|---|---|
| 3,964,683 | 6/1976 | Gimple . | |
| 4,106,697 | 8/1978 | Sickles | 239/705 X |
| 4,228,961 | 10/1980 | Itoh | 239/698 |
| 4,462,061 | 7/1984 | Mommsen . | |
| 4,819,879 | 4/1989 | Sharpless et al. . | |
| 4,987,001 | 1/1991 | Knobbe et al. . | |
| 5,056,720 | 10/1991 | Crum et al. . | |

FOREIGN PATENT DOCUMENTS

| | | | |
|---|---|---|---|
| 2509851 | 9/1976 | Germany . | |
| 2192351 | 1/1988 | United Kingdom | 239/112 |

*Primary Examiner*—Kevin Weldon

*Attorney, Agent, or Firm*—Tarolli, Sundheim, Covell, Tummino & Szabo

[57] ABSTRACT

A particle spray apparatus includes a spray gun having a deflector connected with a housing assembly. An electrode arrangement extends from the housing assembly into the deflector and is exposed to the flow of air with particles entrained therein to electrostatically charge the particles. The electrode arrangement is exposed to a flow of fluid to remove contaminants which may accumulate around components of the electrode arrangement. Accumulation of particles on an end surface of the deflector is discouraged by a flow of fluid from a chamber in the deflector through a porous member. The flow of fluid from the chamber is also conducted through a porous electrode sheet which extends along the porous member. Due to the relatively high voltage conducted through the electrode arrangement, an arc may tend to form in a passage along which fluid is conducted to the electrode arrangement. To prevent this from occurring, the passage through which fluid is conducted to the electrode arrangement is relatively long.

24 Claims, 6 Drawing Sheets

PARTICLE SPRAY APPARATUS AND METHOD

BACKGROUND OF THE INVENTION

An improved particle spray apparatus and method is used to electrostatically charge particles entrained in a flow of air and to direct the flow of air and particles toward a workpiece.

A known apparatus for directing a flow of air with electrostatically charged particles entrained therein toward a workpiece is disclosed in U.S. Pat. No. 4,819,879. This apparatus includes a spray gun having a central passage along which a flow of air with particles entrained therein is conducted. The flow of air with particles entrained therein is radially expanded by engagement with a conical deflector.

The apparatus disclosed in the aforementioned U.S. patent includes an electrical apparatus which electrostatically charges the particles entrained in the flow of air. The electrical apparatus includes various electrode arrangements which are exposed to the flow of air and particles around an axially outer end portion of the deflector. The electrode arrangement may include a silicon carbide electrode sheet which is mounted on the axially outer end portion of the deflector.

Another known particle spray gun is disclosed in U.S. Pat. No. 3,964,683. The particle spray gun disclosed in this patent includes a nozzle in which an electrode support member is mounted. A needle-shaped charging electrode is disposed in a passage which extends through the support member. Air is conducted to the passage in which the electrode is disposed to blow powder off of the electrode. The air is conducted through a passage in a radially extending spoke or strut which supports the support member in the nozzle.

SUMMARY OF THE INVENTION

The present invention provides a new and improved apparatus and method for use in directing a flow of air with particles entrained therein toward a workpiece. An electrode arrangement is provided in the apparatus to electrostatically charge particles entrained in the flow of air. The electrode arrangement is exposed to a flow of air to remove contaminants which may tend to form around the electrode arrangement. In order to retard accumulation of particles on a surface of a deflector, the surface of the deflector is porous and a flow of air is conducted through the porous surface of the deflector.

One embodiment of the electrode arrangement includes a porous electrode sheet which is disposed adjacent to a porous member which forms the porous surface of the deflector. A flow of air is conducted from a chamber in the deflector through the porous electrode sheet and the porous member to retard the accumulation of particles on the porous surface of the deflector. To prevent the formation of an arc in a passage through which the air is conducted to the electrode arrangement, the passage is relatively long and extends at least half way around a passage through which the flow of air with particles entrained therein is conducted through the apparatus.

BRIEF DESCRIPTION OF THE DRAWINGS

The foregoing and other features of the invention will become more apparent upon a consideration of the following description taken in connection with the accompanying drawings wherein.

DESCRIPTION OF SPECIFIC PREFERRED EMBODIMENTS OF THE INVENTION

General Description

Figure 1:
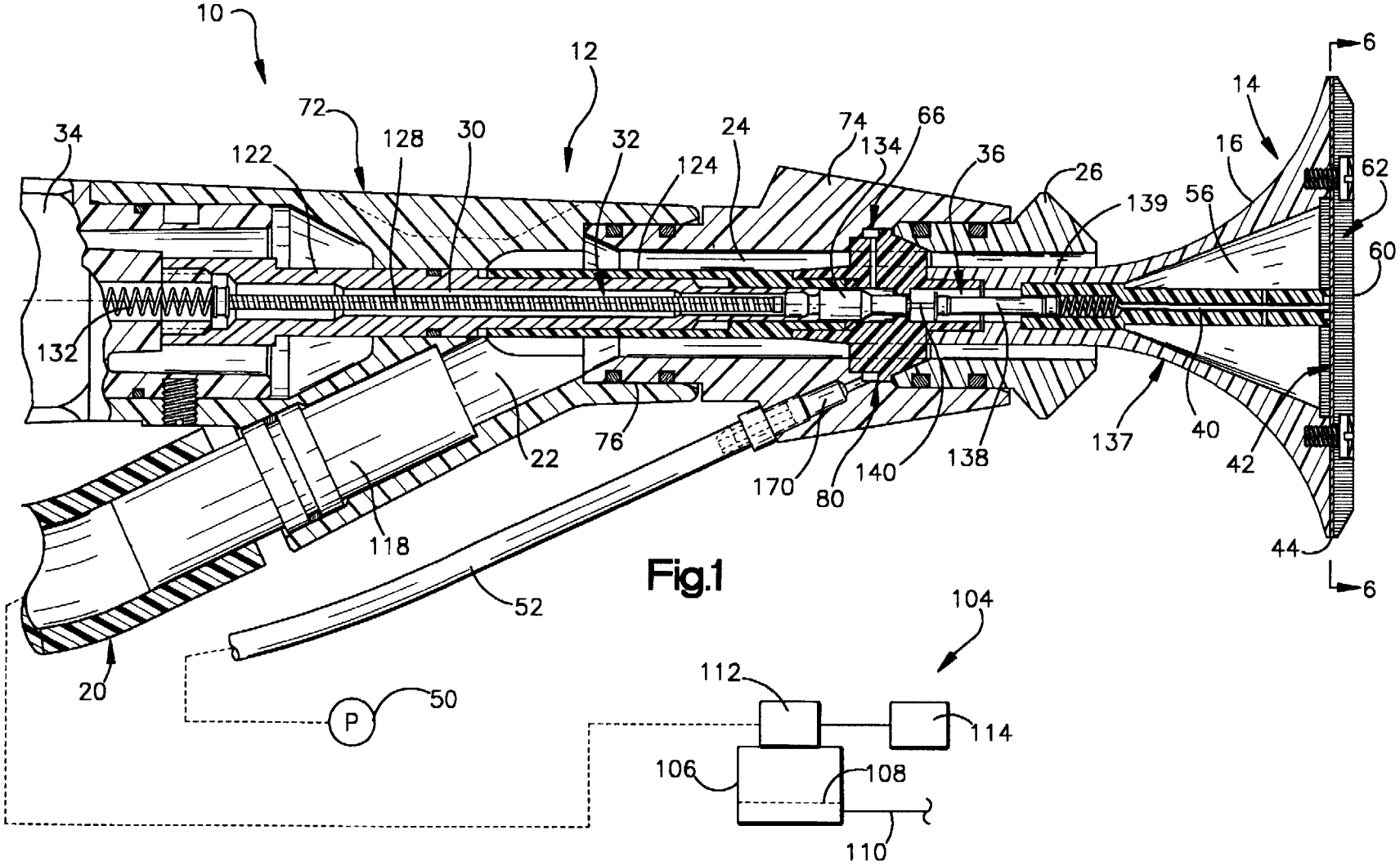
FIG. 1 is a fragmentary sectional view illustrating an apparatus constructed and operated in accordance with the present invention to direct a flow of air with particles entrained therein toward a workpiece.

An apparatus or spray gun 10 for use in directing a flow of air with particles entrained therein toward a workpiece (not shown) is illustrated in FIG. 1. The spray gun 10 includes a housing assembly 12 through which a flow of air with particles entrained therein is conducted. A conical deflector 14 is connected with the housing assembly 12. The flow of air with particles entrained therein flows along a generally conical outer side surface 16 of the deflector 14 to expand the flow of air with particles entrained therein.

The flow of air with particles of powder entrained therein is conducted to the housing assembly 12 (FIG. 1) through a delivery conduit 20. The flow of air with particles of powder entrained therein is conducted from the delivery conduit 20 through an inlet passage 22 to an outer central passage 24 disposed in the housing assembly 12. The outer central passage 24 extends through a nozzle 26 adjacent to the base of the deflector 14. The nozzle 26 directs the flow of air with powder particles entrained therein toward the deflector 14.

An inner central passage 30 in the housing assembly 12 is coaxial with and is circumscribed by the outer central passage 24. An electrical apparatus 32 is disposed within the inner central passage 30 and extends from a voltage multiplier 34 through the housing assembly 12 into the deflector 14. The electrical apparatus 32 includes a voltage multiplier 34 and an electrode arrangement 36. The voltage multiplier 34 supplies a relatively high voltage, in the illustrated embodiment of the invention, about 100,000 volts, to the electrode arrangement 36.

The electrode arrangement 36 (FIG. 1) electrostatically charges particles of powder entrained in the flow of air discharged from the spray gun 10 toward the workpiece. The electrode arrangement 36 includes an electrode rod 40 which is disposed in the portion of the inner central passage 30 located in the deflector 14 and an electrode sheet 42 which is located in an axially outer end portion of the deflector 14. A peripheral edge portion 44 of the electrode sheet 42 is disposed in an axially and radially outer end portion of the deflector 14 and is exposed to the flow of air with particles of powder entrained therein. The relatively high voltage conducted to the electrode sheet 42 through the electrode rod 40 is effective to electrostatically charge the particles entrained in the flow of air as the particles move past the outer end portion of the deflector 14.

In accordance with one of the features of the present invention, at least a portion of the electrode arrangement 36 is exposed to a flow of fluid (air) to remove any contaminants which may accumulate around the electrode arrangement. The flow of air is conducted from a regulated compressed air supply 50 through a fluid supply conduit 52 to the inner central passage 30. The flow of air is conducted along the electrical apparatus, in the part of the inner central passage 30 which is forward of element 134 (later described) to a generally conical chamber 56 in the deflector 14 through passages 192, 194 (FIG. 4) later described.

The electrode rod 40 and other components of the electrical apparatus 32 are disposed in the inner central passage 30. Therefore, the flow of air in the inner central passage 30 forward of element 134 washes away or removes any contaminants which may accumulate adjacent to the electrode rod 40 and/or other components of the electrical apparatus 32 which are forward of element 134. The contaminants may be the result of an interaction between components of the housing assembly 12 and/or deflector 14 and the electrical apparatus 32 due to the high voltage in the electrical apparatus.

During operation of the spray gun 10, powder particles may tend to accumulate on a front surface 60 of the deflector 14. In accordance with another feature of the present invention, the accumulation of particles on the circular front surface 60 of the deflector 14 is retarded by an air flow from the chamber 56 in the deflector. The air flows from the chamber 56 through the porous electrode sheet 42 and through a porous member 62 which comprises the front surface 60 of the deflector 14. The porous member 62 forms a circular front wall of the deflector 14.

During operation of the spray gun 10, the high voltage conducted through the electrical apparatus 32 may cause an arc to form in a passage system 66 (FIG. 1) which connects the air supply conduit 52 with the inner central passage 30. This could occur, for example, if an external ground were positioned where conduit 52 connects to the member 74 (later described) of gun 10. Consequently in accordance with a feature of the present invention, the passage system 66 from the end of the fluid supply conduit 52 to the electrical apparatus 32 within inner central passage 30 is made relatively long and circuitous to prevent the formation of an arc in the passage 66. Thus, the passage system 66 extends at least half way around the outer central passage 24 before being connected with the inner central passage 32. The resulting substantial length and changes in direction of the passage system 66 prevents the formation of an arc to an external ground since the arc would have to travel through the passage system 66 from the electrical apparatus 32 to a ground outside of the housing assembly 12.

Housing Assembly

The housing assembly 12 includes a main housing section 72 (FIG. 1). The voltage multiplier 34 is connected with the main housing section 72. A nozzle extension 74 is also connected with the main housing section 72. The nozzle extension 74 is received in a cylindrical recess 76 formed in the main housing section 72.

A one-piece support structure or spider 80 (FIGS. 1 and 2) is disposed in the nozzle extension 74. The outer central passage 24 extends through arcuate openings 82 and 84 (FIG. 3) formed in the spider 80. The inner central passage 30 extends through a cylindrical central opening 86 formed in the spider 80. The opening 86 is formed in a generally cylindrical central portion 88 of the spider 80. The central portion 88 of the spider 80 is supported by upper and lower struts 92 and 94 which extend between the central portion of the spider and a circular outer ring portion 96 of the spider.

The nozzle 26 (FIG. 2) is received in a cylindrical recess 100 formed in an axially outer end portion of the nozzle extension 74. The main housing section 72 (FIG. 1), nozzle extension 74, spider 80 and nozzle 26 are formed of suitable polymeric material which is electrically insulating. Therefore, the main housing section 72, nozzle extension 74, spider 80 and nozzle 26 are effective to insulate the electrical apparatus 32 from any object in the environment surrounding the spray gun 10 which may be grounded.

During operation of the spray gun 10, a control apparatus 104 (FIG. 1) controls the flow of air with powder entrained therein through the delivery conduit 20 to the spray gun 10. The control apparatus 104 includes a fluidizing bed powder container or hopper 106 which contains powder. A bottom fluidizing bed plate 108 of porous material is disposed in the hopper 106. Fluidizing air is conducted through a conduit 110 to the hopper 106.

The fluidizing air conducted through the conduit 110 through the hopper 106 is directed upward through the fluidizing bed bottom plate 108 into the upper portion of the hopper 106. The flow of fluidizing air through the plate 108 fluidizes the powder in the upper portion of the hopper 106 in a known manner. If desired, a mechanical agitator may be provided in the upper portion of the hopper 106 to promote fluidization of the powder.

The fluidized powder is conducted from the hopper 106 through a venturi pump 112. Operation of the venturi pump 112 is controlled by a gun control module 114 which determines the timing and pressure of air supplied to pump 112 to achieve the desired powder flow to the gun.

The flow of air with powder entrained therein from the venturi pump 112 is conducted through the delivery conduit 20 and a connector fitting 118 to the inlet passage 22 in the main housing section 72 (FIG. 1). The flow of air with powder entrained therein is conducted from the inlet passage 22 into the outer central passage 24. The outer central passage 24 has a tubular cylindrical configuration and extends from the main housing section 72 through the nozzle extension 74, the openings 82 and 84 (FIG. 3) in the spider 80, and through the nozzle 26 (FIG. 1) toward the deflector 14. The outer central passage 24 has an annular cross sectional configuration except when passing through openings 82, 84. Therefore, the flow of air with powder particles entrained therein from the nozzle 26 has an annular cross sectional configuration. The deflector 14 expands the annular flow of air with powder entrained therein from the nozzle 26 radially to form a generally conical spray pattern which covers a substantially greater area than the annular cross sectional configuration of the flow of air with powder entrained therein from the nozzle 26.

Electrical Apparatus

The electrical apparatus 32 is disposed in the inner central passage 30. The inner central passage 30 (FIG. 1) is disposed in a coaxial relationship with and is partially surrounded by the cylindrical tubular outer central passage 24.

The electrical apparatus 32 extends from the voltage multiplier 34 through the inner central passage 30 to an axially outer end portion of the deflector 14. The outer central passage 24 extends along the inner central passage 30 from the main housing section 72 through the nozzle extension 74, spider 80, and nozzle 26. However, unlike the outer central passage 24, the inner central passage 30 extends into the deflector 14 and is connected in fluid communication with the chamber 56 in the deflector.

The left side of passage 30 (in FIG. 1) is formed by the hollow interior diameter of cylindrical probe or casing 122 which is connected to the housing encasing voltage multiplier 34. The probe 122 is supported by the main section 72 of the housing assembly 12. A generally cylindrical wear sleeve 124 encloses a portion of the probe 122. The cylindrical wear sleeve 124 encases the right end of probe 122 in FIG. 1. Wear sleeve 124 is exposed to the flow of air with powder entrained therein conducted from powder inlet 22 through the outer central passage 24.

Wear sleeve 124 is formed of a material which is resistant to abrasion by the powder particles. If wear sleeve 124 becomes abraded after extended use of the spray gun 10, the wear sleeve can be readily replaced. Wear sleeve 124 and probe 122 are supported by and enclosed within a cylindrical portion of spider 80 which extends to the left in FIG. 1.

The electrical apparatus 32 includes a cylindrical resistor stack 128 (FIG. 1) which is located in the portion of the central passage 30 disposed in the probe 122. The resistor stack 128 is connected with the voltage multiplier 34 through a spring 132. Thus, the relatively high output voltage (100 kv) from the voltage multiplier 34 is conducted through the spring 132 to the resistor stack 128. The right end of the resistor stack 128 in FIG. 1 is in electrical contact with a wire 140 which passes through a tip 134, which in turn extends from probe 122 through central opening 86 (FIG. 3) in spider 80. Tip 134 is constructed from a non-conductive material and is connected to the right most end of probe 122 in FIG. 1.

The open space in the portion of the inner central passage 30 which extends along the resistor stack 128 is filled with dielectric grease which provides electrical insulation around the resistor stack 128. A grease tight seal is formed between the tip 134 and the probe 122. The hole provided in tip 134 for accepting wire 140 is slightly smaller than wire 140 to provide a friction fit and prevent grease from entering tip 134. Open space is provided between outer side surfaces of the electrical apparatus 32 and the inner side surfaces of the inner central passage disposed to the right (as viewed in FIG. 1) of the tip 134 to enable air to flow along this portion of the inner central passage. An O-ring 300 centers tip 134 in the passage 32 through spider 80 and prevents air from flowing back past tip 134.

In addition to the resistor stack 128, the electrical apparatus 32 includes a second resistor 138 (FIG. 4) which is disposed in a portion of the central passage 30 which extends into the deflector 14. The deflector 14 has a hollow rigid housing 137 (FIG. 4) formed of a suitable polymeric material which is electrically insulating. The resistor 138 is disposed in a cylindrical stem portion 139 of the deflector housing 137 and is electrically connected with the resistor stack 128 by pin 140 which passes through tip 134 to a contact washer 142. Contact washer 142 makes electrical contact with resistor 138.

Figure 4:
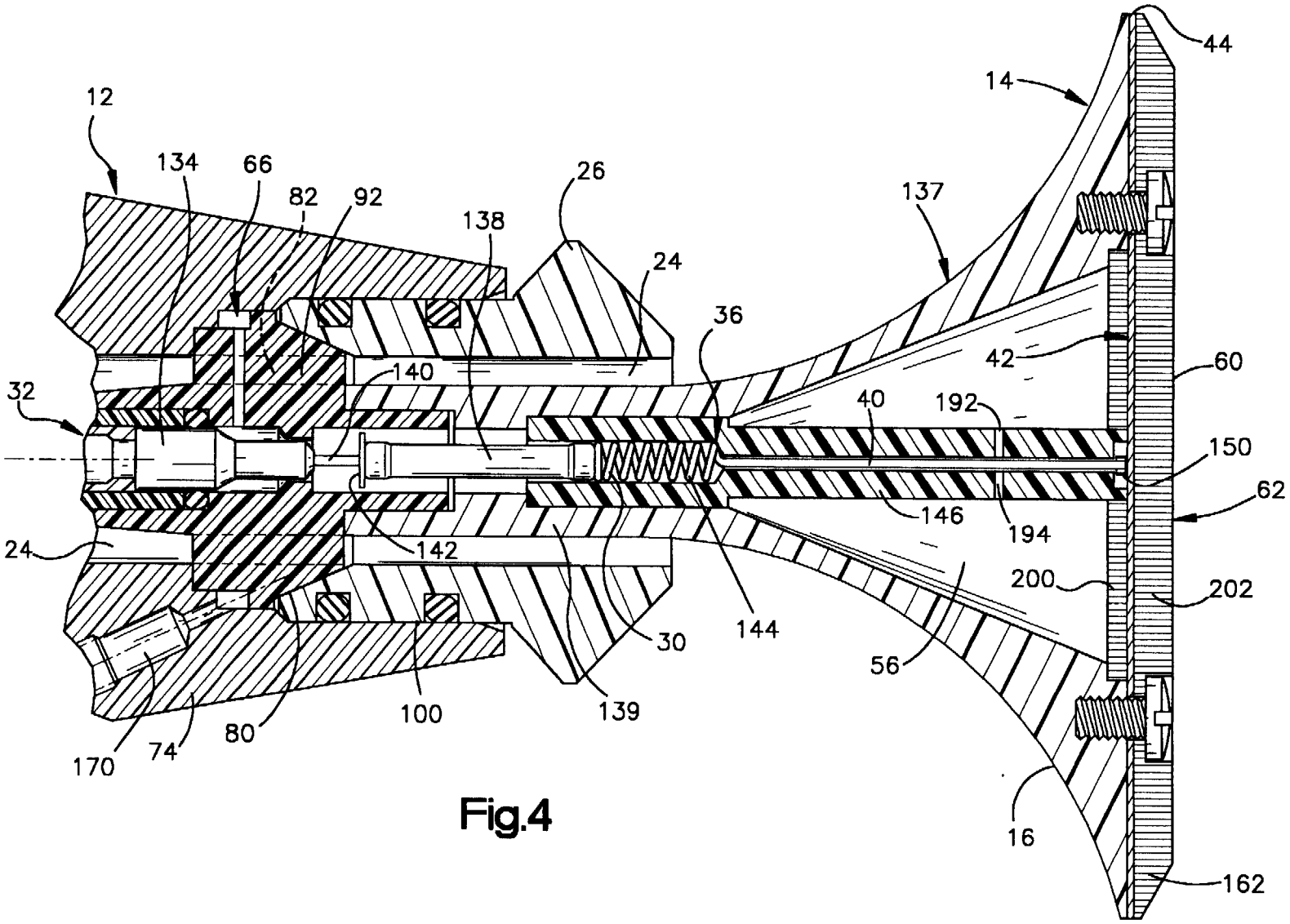
FIG. 4 is an enlarged fragmentary sectional view of a portion of FIG. 1 and illustrating the relationship of a deflector to the inner and outer central passages and to the electrical apparatus.

A spring 144 contacts the right end of resistor 138 in FIG. 4 and includes a right end which is formed as a straight electrode 40. Electrode 40 extends along a portion of the inner central passage 30 which is disposed in a cylindrical support 146.

Cylindrical support 146 extends axially through the conical chamber 56 and has a central axis which is coincident with the central axis of the chamber. The left (as viewed in FIG. 4) end of the support 146 is coaxial with and is supported by the stem portion 139 of the deflector 14. The support 146 is formed of a suitable polymeric material which is electrically insulating.

Figure 5:
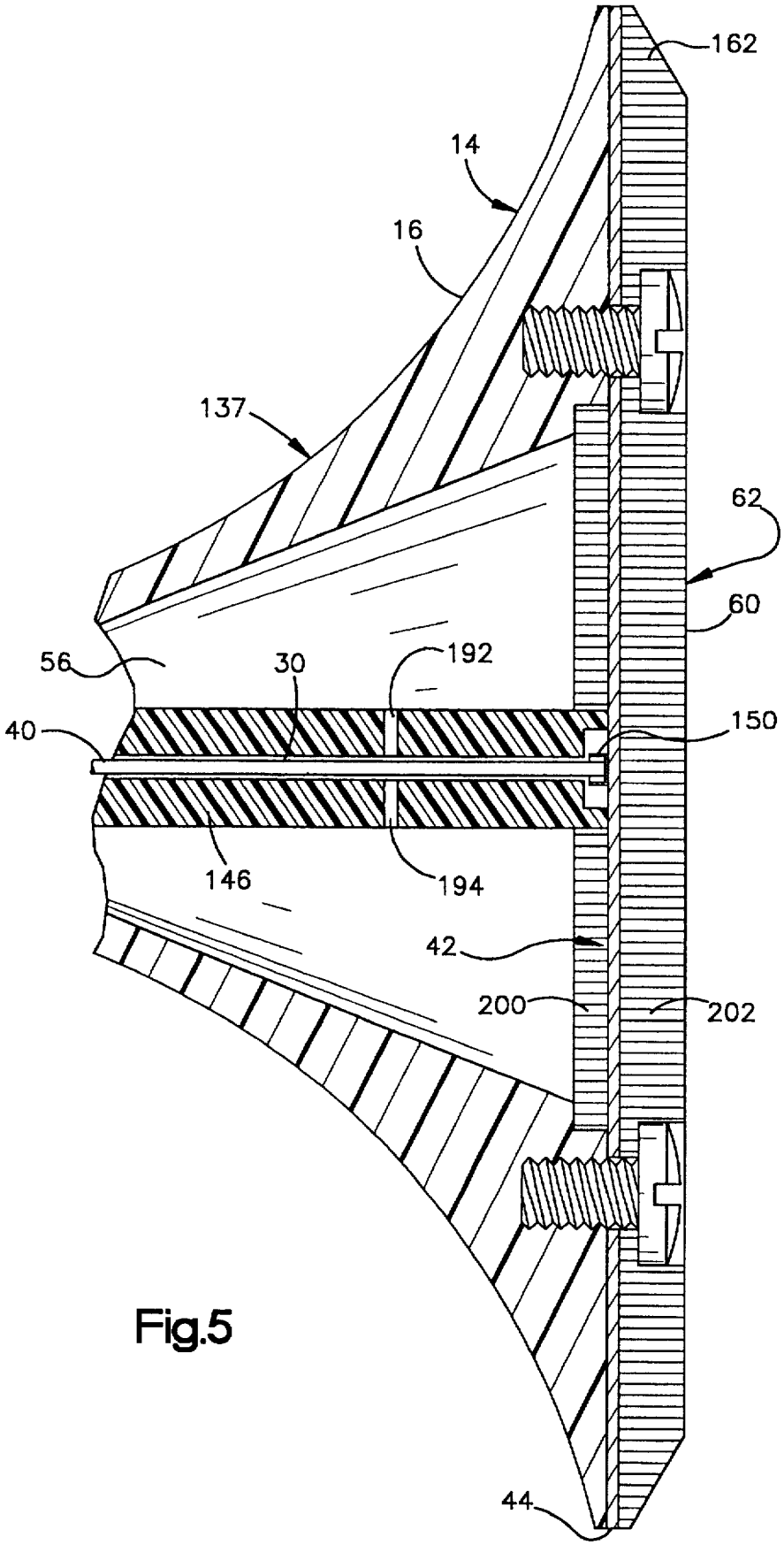
FIG. 5 is an enlarged fragmentary sectional view of a portion of FIG. 4 and illustrating the relationship of the deflector to an electrode arrangement which electrostatically charges particles entrained in the flow of air.

A cup-shaped metal eyelet or contact 150 (FIG. 5) connects the right end of electrode 40 as shown in FIG. 5 with the electrode sheet 42. Since the left end of electrode 40 is formed as a spring, eyelet 150 is spring biased into contact with sheet 42. Voltage is conducted from the voltage multiplier 34 (FIG. 1) through the resistor 128, pin 140, washer 142, resistor 138, electrode 40, and metal eyelet 150 to the electrode sheet 42.

Figure 6:
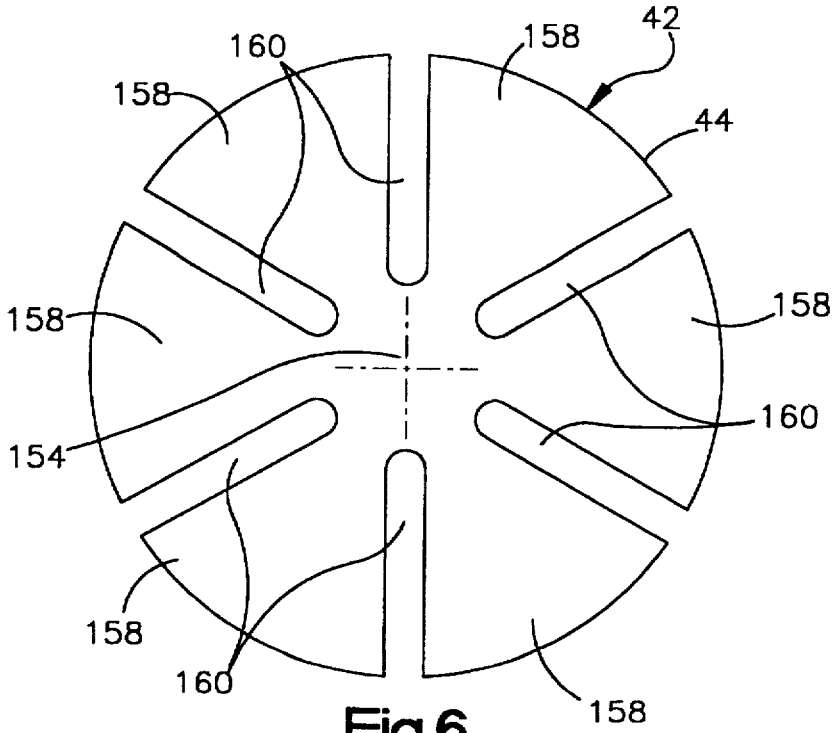
FIG. 6 (on sheet 3 of the drawings) is a plan view, taken generally along the line 6—6 of FIG. 1, of an electrode sheet used in the electrode arrangement of FIG. 5.

The electrode sheet 42 has a circular configuration (FIG. 6). The cup-shaped eyelet 150 (FIG. 5) abuts a central portion 154 (FIG. 6) of the electrode sheet 42. The electrode 40 (FIG. 5) has a longitudinal central axis which extends perpendicular to the electrode sheet 42. The electrode sheet 42 has a major side surface which extends parallel to the front surface 60 of the deflector 14.

The electrode sheet 42 (FIG. 6) is formed into a plurality of generally pie-shaped arcuate segments 158 by a plurality of slots 160 which extend radially outwardly from the central portion 154 of the electrode sheet. The peripheral edge portion 44 of the electrode sheet 42 is divided into a plurality of arcuate sections by the slots 160. The electrode sheet 42 may be a porous non-woven fabric formed of fibers which are electrically resistive such as the silicon carbide material disclosed in U.S. Pat. No. 4,819,879 which is hereby incorporated by reference in its entirety. Electrical energy is conducted from the electrode 40 and eyelet 150 to the central portion 154 of electrode sheet 42. This electrical energy is conducted through the electrode sheet 42 to the peripheral edge portion 44 of the electrode sheet.

The peripheral edge portion 44 of the electrode sheet 42 is exposed at the circumference 162 of the deflector 14 (FIG. 5). Particles of powder entrained in the flow of air which is conducted along the deflector 14 are electrostatically charged by the electrode sheet 42 in a manner described in U.S. Pat. No. 4,819,879. Briefly, a corona discharge is produced at the ends of the fibers which are exposed at the peripheral edge portion 44 of the electrode sheet 42. This corona discharge causes an electrostatic charge to be imparted to particles of powder which flow past the peripheral edge portion 44 of the electrode sheet 42.

In the specific embodiment of the invention illustrated in FIGS. 5 and 6, the electrode sheet 42 is formed of silicon carbide fibers which form a porous non-woven fabric. This non-woven silicon carbide fiber fabric is commercially available from Dow Corning Corporation of Midland, Mich. under the trademark NICALON and has the characteristics set forth in the previously mentioned U.S. Pat. No. 4,819,879. Of course, the porous electrode sheet 42 could be formed of a different electrically resistive material if desired.

Instead of the electrode sheet 42, any one of many different electrode arrangements could be utilized to electrostatically charge the powder particles as they flow past the radially and axially outer end portions of the deflector 14. Thus, a circular array of electrode elements could extend radially outwardly from the end of the electrode rod 40 to the axially and radially outer end portion of the deflector 14. The radially outer ends of the electrode elements could be exposed to the flow of air with particle elements entrained therein to enable the particles to be electrostatically charged. If desired, resistors could be provided in association with the electrode elements. Alternatively, an annular silicon carbide thread, ribbon or band could be disposed at the radially and axially outer end portion of the deflector 14 and electrically connected with the electrode 40 in the manner disclosed in the aforementioned U.S. Pat. No. 4,819,879.

Air Supply

A flow of air is conducted along the right side of central passage 30 (FIGS. 1 and 4) to remove any contaminants which may collect adjacent to components of the electrode arrangement 36. The flow of air is conducted from the spider 80 through the central passage 30 into the chamber 56 in the deflector 14. To prevent the accumulation of powder particles on the front surface 60 of the deflector 14 and to remove contaminants which may accumulate adjacent to the electrode sheet 42, a flow of air is conducted from the chamber 56 through the porous electrode sheet 42 and porous member 62 of deflector 14. If separate electrode elements, such as wires which extend radially outward from the electrode rod 40, are utilized instead of the electrode sheet 42, the flow of air would remove any contaminants which may accumulate adjacent to the electrode elements.

Figure 2:
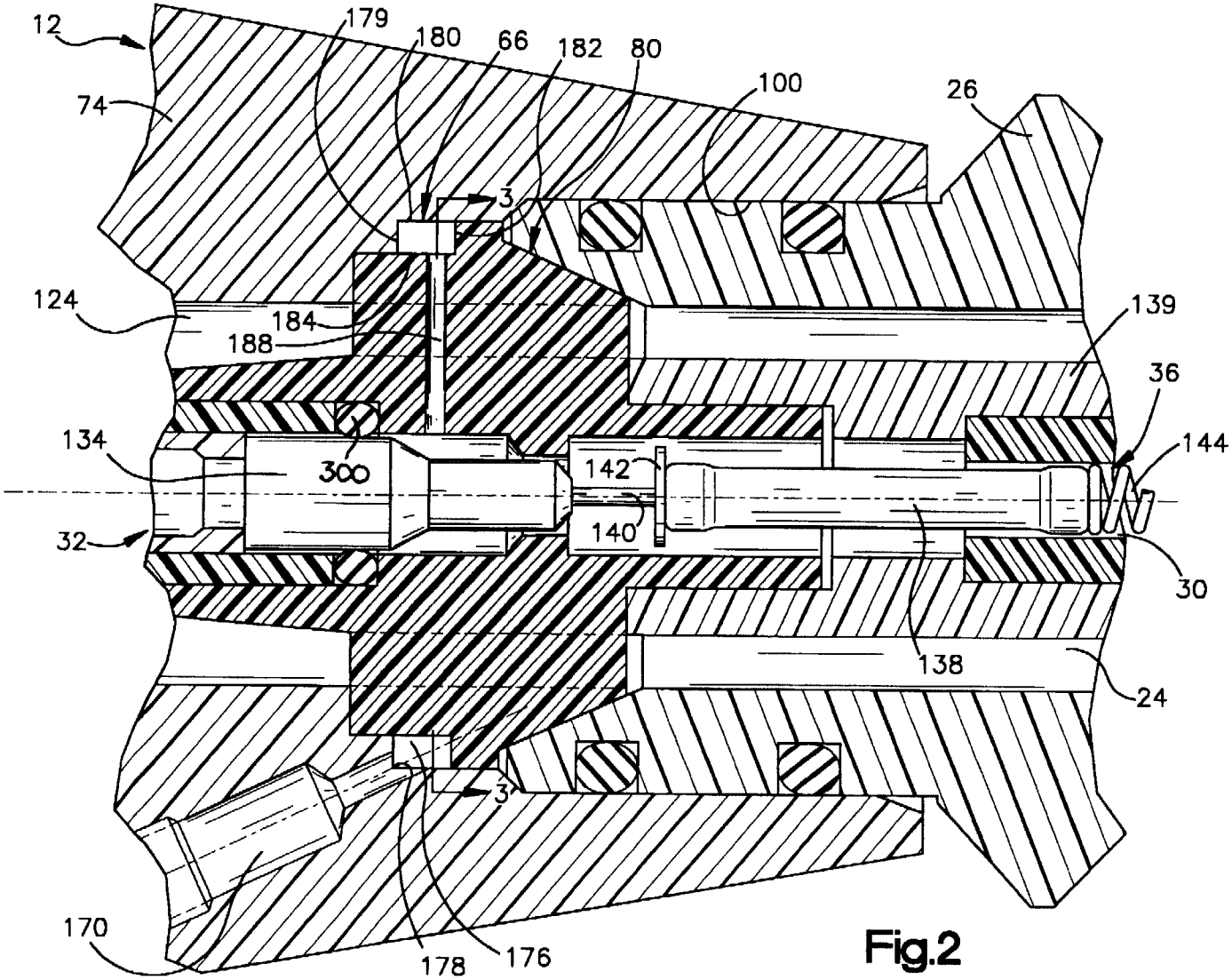
FIG. 2 is an enlarged fragmentary sectional view of a portion of FIG. 1 and illustrating the relationship between an inner central passage which contains electrical apparatus and an outer central passage which extends around the inner central passage and conducts the flow of air with particles entrained therein.
Figure 3:
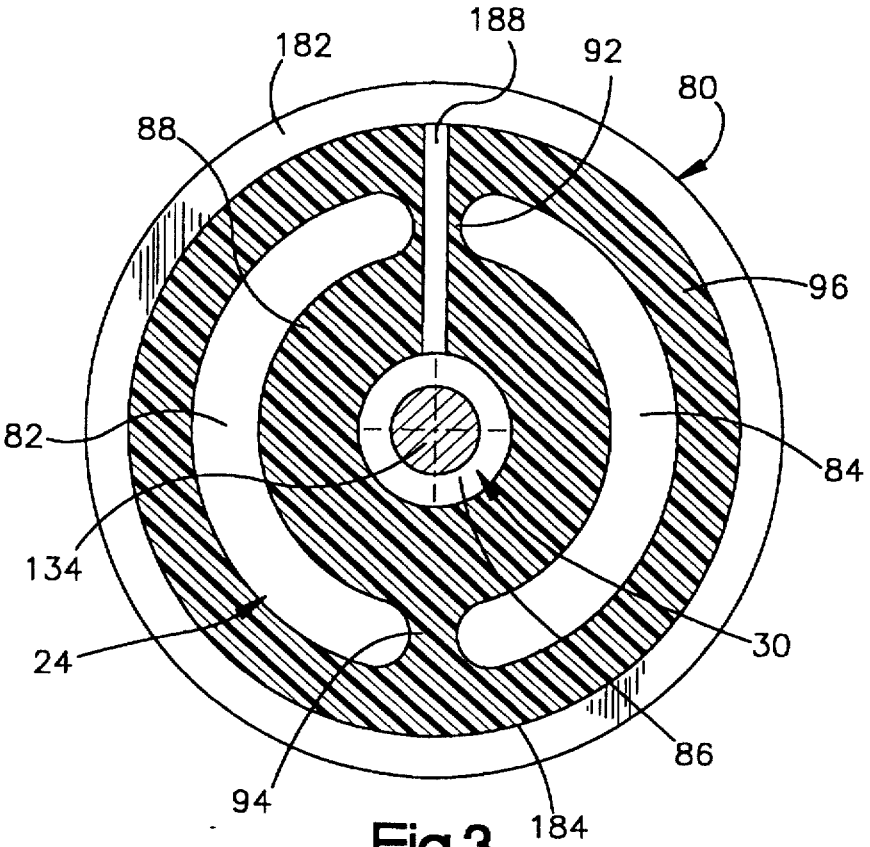
FIG. 3 is a sectional view, taken generally along the line 3—3 of FIG. 2, illustrating the construction of a support structure through which the inner and outer central passages extend.

The fluid supply conduit 52 (FIG. 1) is connected with an inlet passage 170 (FIGS. 1 and 4) formed in the nozzle extension 74. The inlet passage 170 is connected with the inner central passage 30 through the relatively long and circuitous passage system 66 (FIG. 2).

The passage system 66 (FIG. 2) includes an annular intermediate passage 176 which is connected with the inlet passage 170 at a location 178 disposed radially outwardly from the outer central passage 24. The annular intermediate passage 176 extends around and is coaxial with the outer central passage 24 and the inner central passage 30. The annular intermediate passage 176 is formed between the inner side surfaces on the nozzle extension 74 and outer side surfaces on the spider 80. Thus, a flat annular side surface 179 and a cylindrical side surface 180 on the nozzle extension 74 cooperate with a flat annular shoulder surface 182 and a cylindrical surface 184 formed on the spider 80 (FIG. 2) to form the annular intermediate passage 176.

A radially extending connector passage 188 is formed in the spider 80 and extends through the upper strut 92 (FIG. 3) to the inner central passage 30. The radially extending connector passage 188 (FIG. 2) is connected with the annular intermediate passage 176 at a location which is diametrically opposite from the location 178 where the inlet passage 170 is connected with the annular intermediate passage. Therefore, air must flow half way around the cylindrical outer side surface 184 on the spider 80 before entering the passage 188.

An electrical arc or spark which is to extend from the electrical apparatus 32 through the passage system 66 will have to extend along the connector passage 188 to the annular intermediate passage 176. The electrical arc would then have to extend along one half (180°) of the length of the annular intermediate passage 176 before entering the inlet passage 170 and finally arriving at an external ground positioned adjacent to the end of conduit 52. This relatively long and circuitous distance prevents an arc to be established in the passage system 66 between the electrical apparatus 32 and an external ground adjacent to the air inlet passage 170.

Once the air has been conducted from the fluid supply conduit 52 through the passage system 66 to the inner central passage 30, the fluid flows along the components of the electrical apparatus 32. Thus, the air flows axially along the exterior of tip 134 (FIG. 2) and along the second resistor 138 (FIG. 2) into the portion of the inner central passage 30 disposed in the support member 146 (FIG. 4). The air then flows from the portion of the inner central passage 30 in the support member 146 through passages 192 and 194 (FIG. 5) into the chamber 56.

From the chamber 56, the fluid flows through the porous member 62 and the fibrous electrode sheet 42 to the atmosphere around the deflector 14. In the illustrated embodiment of the invention, the porous member 62 forms the front wall of the deflector 14. In this specific embodiment, the porous member 62 is formed by a porous rigid circular rear plate 200 and a porous rigid circular front plate 202. The fibrous electrode sheet 42 is disposed between the front and rear plates 200 and 202. The right (as viewed in FIG. 5) end of the support member 146 is supported in an opening in the rear plate 200.

The front and rear plates 200 and 202 are formed of a an electrically insulating porous material. The electrode sheet 42 is formed of a porous material, that is a non-woven silicon carbide fabric. Therefore, air pressure in the chamber 56 can induce a flow of air from the chamber through the porous rear plate 200, electrode sheet 42 and front plate 202. The flow of fluid through the front plate 202 is effective to prevent the accumulation of particles of powder on the circular front surface 60 of the deflector 14.

In the embodiment of the invention illustrated in FIGS. 4 and 5, the porous rear plate 200 and porous front plate 202 are formed of high density polyethylene which is commercially available from Porex Technologies having a place of business at 500 Bohannon Road, Fairburn, Ga.

It is contemplated that the porous member 62 in the deflector 14 may be formed with only a single porous plate, that is the front plate 202. The rear plate 200 may be eliminated. If this is done, the electrode sheet 42 may be secured to the porous front plate 202 with adhesive or other fasteners.

It is also contemplated that the porous front plate 202 may be formed of an electrically insulating material other than high density polyethylene. For example, the porous front plate and/or the porous rear plate 200 may be formed by a flat sheet of electrically insulating material in which holes have been formed by drilling or other mechanical processes. It is also contemplated that a relatively flexible mesh of electrically insulating material could be used to form the porous rear and/or front plates 200 and 202 if desired. If desired, a porous, electrically insulating material could be molded around electrode elements to form the porous screen 62 as one piece.

In the embodiment of the porous screen 62 illustrated in FIGS. 4 and 5, the entire rear and front plates 200 and 202 are formed of porous material. This is advantageous since it enables the flow of fluid from the chamber 56 to be conducted through the entire end surface of the chamber. However, if desired, a portion of the rear plate 200 and/or front plate 202 could be nonporous.

Operation

When the spray gun 10 is to be operated, the spray gun may be mounted on a fixture or other support structure. The delivery conduit 20 (FIG. 1) is connected with the venturi pump 112 in the control apparatus 104 and the air supply conduit 52 is connected with the regulated compressed air supply 50. A grounded workpiece (not shown) is positioned in front of the spray gun 10.

Upon actuation of the gun control module 114, air with powder entrained therein is conducted from the hopper 106 through the pump 112 and delivery conduit 20 to the inlet passage 22 in the housing assembly 12 of the spray gun. The air with powder entrained therein is then conducted along the passage 24 toward the nozzle 26. The flow of air with powder entrained therein is then deflected radially outwardly by the outer side surface 16 of the deflector 14 to expand the cloud of powder coating material to have a relatively large, generally conical, spray pattern.

At the same time, air under pressure is conducted from the pump 50 through the fluid supply conduit 52 to the passage system 66. The flow of air in the passage system 66 is conducted half way around the annular intermediate passage 176 (FIG. 2) from the inlet 178 to the connector passage 188. The air then flows from the passage 188 into the inner central passage 30.

The air is conducted along the passage 30 to the chamber 56 in the deflector 14. As the air flows along the passage 30, it washes away or removes any contaminants which may form adjacent to the components of the electrical apparatus 32. The air then flows into the deflector chamber 56 through the passages 192 and 194 in the support member 146 which extends through the chamber 56.

The air pressure in the chamber 56 causes the air to flow through the inner porous plate 200, the fibrous electrode sheet 42 and the porous outer plate 202 out the front of the deflector 14. Since the front surface 60 on the porous member 62, which forms an end wall of the deflector 14, faces toward the workpiece, particles of powder would normally tend to accumulate on the front surface 60 of the porous member 62. However, the flow of air from the chamber 56 through the porous member 62 prevents powder from accumulating on the front surface 60 of the deflector 14. In addition, the flow of air through the porous screen 62 and the electrode sheet 42 washes away or removes any contaminants which may tend to accumulate adjacent to the electrode sheet.

During use of the spray gun 10, it is important to avoid the formation of an arc between the spray gun and a grounded member which is brought close to the spray gun. To prevent the formation of an arc extending from the electrical apparatus 32 through the passage system 66 (FIG. 2) to the inlet passage 170 for the fluid supply conduit 52, the passage system is relatively long and circuitous, as has been described above. The arc prevention feature of this invention is not limited to guns having conical deflectors but would also apply to guns having other spray nozzles such as flat spray nozzles.

Second Embodiment of the Invention

The air with powder particles entrained therein flows from the delivery conduit 20 (FIG. 1) through the inlet passage 22 into the passage 24. As this occurs, the powder particles tend to become concentrated adjacent in the upper (as viewed in FIG. 1) portion of the passage 24 opposite from the inlet passage 22 due to their momentum and the orientation of inlet 22. To reduce this concentration of powder in the upper part of passage 24, in the embodiment of the invention illustrated in FIG. 7, air is injected into the upper part of passage 24 to pressurize this area and discourage powder flow into it. Since the embodiment of the invention illustrated in FIG. 7 is generally similar to the embodiment of the invention illustrated in FIGS. 1–6, similar numerals will be utilized to designate similar components, the suffix letter "a" being associated with the numerals of FIG. 7 to avoid confusion.

Figure 7:
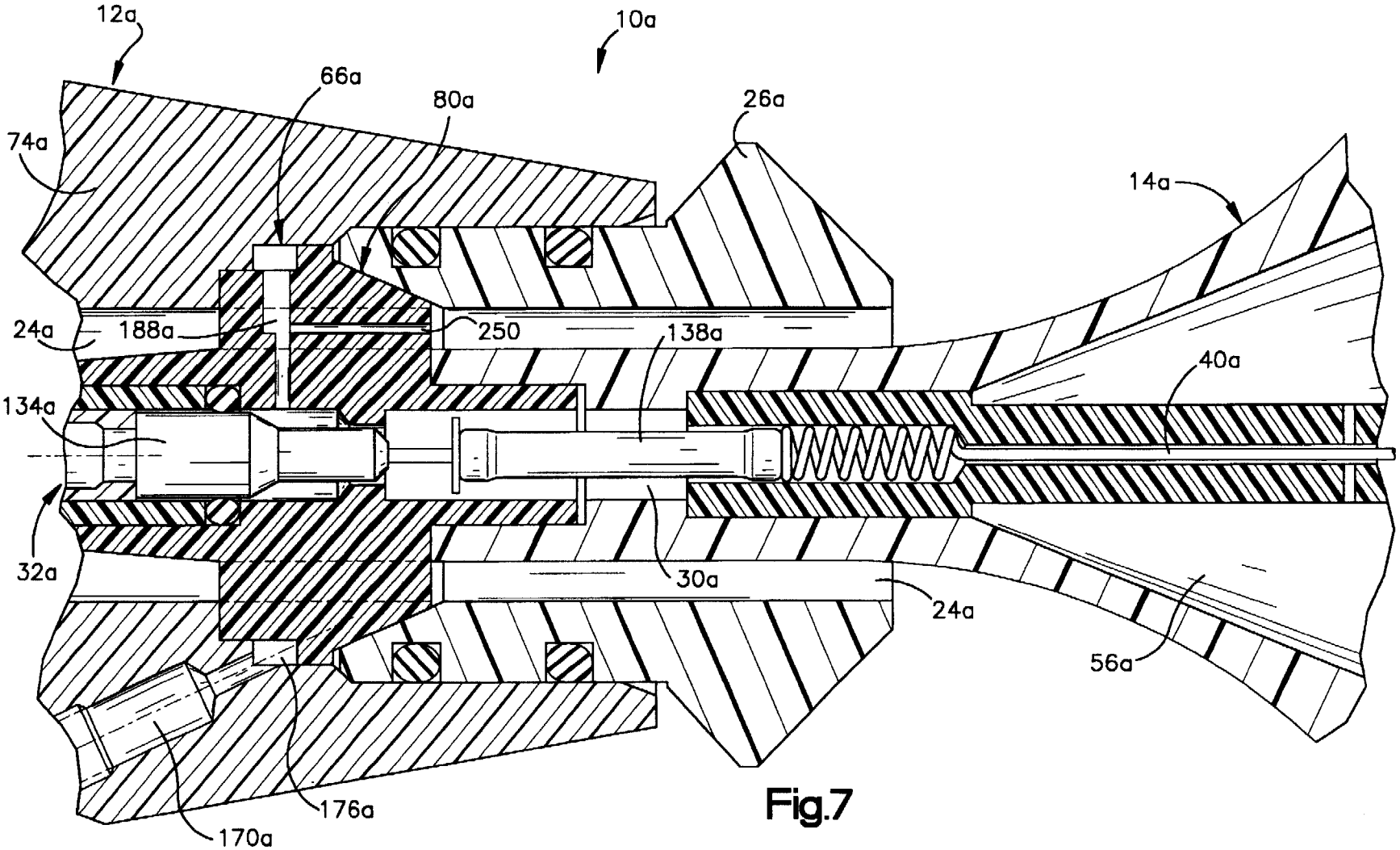
FIG. 7 is a fragmentary sectional view, generally similar to FIG. 2, of a second embodiment of the apparatus of FIG. 1.

In the embodiment of the invention illustrated in FIG. 7, the powder spray gun **10*a* includes a housing assembly 12*a* having a nozzle extension 74*a* in which a nozzle 26*a* and spider 80*a* are received. A flow of air with powder entrained therein is conducted along an outer central passage 24*a*. An electrical apparatus 32*a* is disposed in an inner central passage 30*a*. A flow of air is conducted through a passage system 66*a* to inner central passage 30*a* and then to a chamber 56*a* in a deflector 14*a***.

In accordance with a feature of the embodiment of the invention illustrated in FIG. 7, the passage system **66*a* includes a air injection passage 250 which extends between the connector passage 188*a* and the outer central passage 24*a*. Air under pressure is conducted through the injection passage 250 into the flow of air with powder entrained therein which is flowing through the outer central passage 24*a*. The flow of air from the injection passage 250 increases air pressure in the upper part of passage 24 which forces more powder down into the lower part of passage 24 to promote more even distribution of the powder entrained in the flow of air conducted through the passage 24*a*. In addition, by sending the powder through the arcuate flow paths 82, 84 in spider 80, the powder streams along the top and bottom of flow path 24 are split by the struts 92, 94 and concentrated, and then remixed at the downstream end of spider 80 to better homogenize the powder prior to deflector 14**.

In summary the present invention provides a new and improved apparatus 10 and method for use in directing a flow of air with particles entrained therein toward a workpiece. An electrode arrangement 36 is provided in the apparatus to electrostatically charge particles entrained in the flow of air. The electrode arrangement 36 is exposed to a flow of fluid air to remove any contaminants which may tend to form around the electrode arrangement. In order to discourage accumulation of particles on a surface 60 of a deflector 14, the surface of the deflector is porous and a flow of fluid is conducted through the porous surface.

One embodiment of the electrode arrangement includes a porous electrode sheet 42 which is disposed adjacent to a porous screen 62 which forms the porous surface 60 of the deflector 14. A flow of air is conducted from a chamber in the deflector 14 through the porous electrode sheet 42 and the porous member 62 to retard the accumulation of particles on an end surface 60 of the deflector. To prevent the formation of an arc in a passage 66 through which the air is conducted to the electrode arrangement 36, the passage 66 is relatively long and preferably extends at least half way around a passage 24 through which the flow of air with particles entrained therein is conducted through the apparatus 10.

Having described the preferred embodiment of the invention and an alternative embodiment it is to be understood that many modifications can be made by those skilled in the art within the scope of the invention and that the invention is intended to be limited only by the scope of the appended claims.

The following is claimed:

1. A method comprising the steps of directing a flow of air with particles entrained therein toward a workpiece, deflecting at least a portion of the flow of air with particles entrained therein with a deflector, electrostatically charging particles entrained in the flow of air with electrical apparatus which includes a porous electrode sheet disposed in the deflector, and conducting a flow of fluid through the porous electrode sheet thereafter through and a porous outer surface area on the deflector.

2. A method as set forth in claim 1 further including the step of conducting a flow of fluid along an elongated electrode disposed in the electrical apparatus and connected with the porous electrode sheet, said step of conducting a flow of fluid through the porous electrode sheet and porous surface area on the deflector includes flowing through the porous electrode sheet and porous surface area on the deflector fluid which had previously been conducted along the elongated electrode.

3. A method as set forth in claim 1 further including conducting a flow of fluid into a chamber disposed in the deflector, said step of conducting a flow of fluid through the porous electrode sheet and porous surface area on the deflector includes conducting a flow of fluid from the chamber in the deflector through the porous electrode sheet and thereafter through the porous outer surface area on the deflector.

4. An apparatus for use in directing a flow of air with particles entrained therein toward a workpiece, said apparatus including a deflector which engages the flow of air with particles entrained therein, said deflector including a porous member and a chamber which is disposed adjacent to said porous member, charging elements disposed in said deflector to electrostatically charge particles entrained in the flow of air, said charging elements including an elongated electrode, and a conduit connected with a source of fluid pressure and with the chamber in said deflector to conduct fluid which flows from said conduit to the chamber in said deflector and which flows from the chamber in said deflector through said porous member, said deflector including a tubular member which at least partially encloses said elongated electrode, said tubular member at least partially defining a passage which is connected in fluid communication with the chamber in said deflector and with said conduit to enable a flow of fluid from said conduit to be conducted through the passage into the chamber, said elongated electrode being at least partially disposed in the passage in said tubular member and exposed to fluid flow through the passage.

5. The apparatus of claim 4 wherein said charging elements include one or more charging electrodes mounted on said deflector.

6. An apparatus as set forth in claim 4 wherein said charging elements include a porous electrode sheet which extends across at least a portion of said porous member and is connected with said elongated electrode.

7. An apparatus as set forth in claim 4 wherein said deflector has a circular end surface which faces toward the workpiece and on which particles from the flow of air with particles entrained therein tend to accumulate, said circular end surface of said deflector being at least partially comprised of said porous member, said flow of fluid from the chamber in said deflector through said porous member being effective to discourage accumulation of powder on at least a portion of said circular end surface of said deflector.

8. An apparatus as set forth in claim 4 further including a housing assembly connected with said deflector, said housing assembly having an outer central passage along which the flow of air with particles entrained therein is conducted, said housing assembly having an inner central passage which is at least partially circumscribed by said outer central passage and is connected with the chamber in said deflector, at least a portion of said charging elements being disposed in said inner central passage, said conduit being connected with said housing assembly at a first location offset outwardly from said outer central passage and disposed adjacent to a first side of said outer central passage, an intermediate passage disposed within said housing assembly outwardly of and extending at least half way around said outer central passage, said intermediate passage extending at least half way around said outer central passage from a first location adjacent to a connection between said conduit and said housing assembly to a second location adjacent to a side of said outer central passage opposite from said first location, said housing assembly including a strut portion which extends inwardly through said outer central passage to a portion of said housing assembly which at least partially defines the inner central passage, a connector passage extending inwardly from the intermediate passage to the central passage to enable fluid to be conducted to the chamber in said deflector from said conduit along a flow path which extends through the intermediate passage and the connector passage to the inner central passage.

9. An apparatus for use in directing a flow of air with particles entrained therein toward a workpiece, said apparatus comprising a deflector which engages the flow of air with particles entrained therein, said deflector including a porous member which is formed of an electrically insulating material, said porous member having an outer side surface which is exposed to the flow of air with particles entrained therein and an inner side surface which is disposed within said deflector, a porous electrode sheet which is formed of an electrically conductive material to conduct electrical energy to electrostatically charge particles entrained in the flow of air, said porous electrode sheet being disposed in said deflector and having a central portion which is disposed in engagement with said inner side surface of said porous member and is at least partially blocked from exposure to the flow of air with particles entrained therein by said porous member, said porous electrode sheet having a peripheral portion which is exposed to the flow of air with particles entrained therein at a location adjacent to a peripheral portion of said porous member, and a conduit connected with a source of fluid pressure to conduct fluid which flows from the source of fluid pressure through said porous electrode sheet and then flows through said porous member.

10. An apparatus as set forth in claim 9 wherein said deflector has a generally conical configuration and flares radially and axially outward in the direction of flow of air with particles entrained therein, said peripheral portion of said porous electrode sheet being exposed to the flow of air with particles entrained therein at a radially and axially outer end portion of said deflector.

11. An apparatus as set forth in claim 9 further including a rod-shaped electrode which is connected with said porous electrode sheet and which extends along a passage disposed in said deflector, said passage being connected in fluid communication with the source of fluid pressure to enable said passage to conduct a flow of fluid along said rod-shaped electrode toward said porous electrode sheet.

12. An apparatus as set forth in claim 9 wherein said apparatus includes a housing assembly, said deflector being connected with said housing assembly, said housing assembly at least partially defining an inner central passage which extends from said housing assembly into said deflector and through which a flow of fluid from the source of fluid pressure is conducted into said deflector, a source of electrical energy, an electrode at least partially disposed in said inner central passage and connected with said source of electrical energy and said porous electrode sheet to conduct electrical energy from said source of electrical energy to said porous electrode sheet, said housing assembly at least partially defining an outer central passage which is disposed in a coaxial relationship with and extends around at least a portion of the inner central passage and through which the flow of air with powder entrained therein is conducted toward said deflector.

13. An apparatus for directing a flow of air with particles entrained therein toward a workpiece, said apparatus comprising a housing assembly, a spray nozzle connected with said housing assembly to spray the flow of air with particles entrained therein, said housing assembly at least partially defining an inner central passage which extends from said housing assembly to the spray nozzle and through which a flow of fluid is conducted, an electrode arrangement at least partially disposed in said inner central passage, at least a portion of said electrode arrangement being exposed to the flow of air with particles entrained therein to electrostatically charge particles entrained in the flow of air, said housing assembly having surfaces which at least partially define an outer central passage which is disposed in a coaxial relationship with the inner central passage and which extends around and axially along at least a part of said inner central passage and through which the flow of air with particles entrained therein is conducted toward said spray nozzle, said housing assembly including a strut which extends through a portion of the outer central passage and is exposed to the flow of air with particles entrained therein, said housing assembly having surfaces which define a connector passage which communicates with the inner central passage through said strut, said connector passage extending around at least a part of said outer central passage, and a conduit connected with said housing assembly and with a fluid source from which fluid is conducted along a flow path which extends from the conduit to the connector passage.

14. An apparatus as set forth in claim 12 wherein said spray nozzle includes a deflector having an internal chamber connected to a source of pressurized fluid, and wherein at least a portion of said deflector is porous to enable fluid flow from the chamber in said deflector.

15. An apparatus as set forth in claim 12 wherein said electrode arrangement includes a porous electrode sheet mounted to said deflector and through which fluid flows from the chamber in said deflector.

16. An apparatus for directing a flow of air with particles entrained therein toward a workpiece, said apparatus comprising a housing assembly, a spray nozzle connected with said housing assembly to spray the flow of air with particles entrained therein, a deflector connected with said housing assembly, said deflector having an outer side surface which flares radially and axially outward in the direction of flow of air with particles entrained therein and which is engaged by the flow of air with particles entrained therein, said deflector having a chamber disposed therein and a porous member which forms a surface of said deflector through which fluid flow is conducted from said chamber, said housing assembly at least partially defining an inner central passage which extends from said housing assembly to said deflector and through which a flow of fluid is conducted to the chamber in said deflector, an electrode arrangement at least partially disposed in said inner central passage and in the chamber in said deflector, at least a portion of said electrode arrangement being exposed to the flow of air with particles entrained therein adjacent to said porous member and to an axially outer end of said outer side surface of said deflector to electrostatically charge particles entrained in the flow of air conducted through said spray nozzle, said housing assembly having surfaces which at least partially define an outer central passage which is disposed in a coaxial relationship with the inner central passage and which extends around and axially along at least a part of said inner central passage and through which the flow of air with particles entrained therein is conducted toward said spray nozzle and said deflector, said housing assembly including a strut which extends through a portion of the outer central passage and is exposed to the flow of air with particles entrained therein, said housing assembly having surfaces which define a connector passage which communicates with the inner central passage through said strut, and a conduit connected with said housing assembly and with a fluid source from which fluid is conducted along a flow path which extends from the conduit to the connector passage and to the chamber in said deflector, at least a portion of said electrode arrangement in said inner central passage and at least a portion of said electrode arrangement in said deflector being exposed to the flow of fluid conducted to the chamber in said deflector.

17. An apparatus as set forth in claim 12 wherein said electrode arrangement includes a porous electrode sheet disposed in said deflector, said porous electrode sheet having a major side surface which is disposed in engagement with said porous member.

18. An apparatus for directing a flow of air with particles entrained therein toward a workpiece, said apparatus comprising a housing assembly, a spray nozzle connected with said housing assembly to spray the flow of air with particles entrained therein, a deflector connected with said housing assembly, said deflector having an outer side surface which flares radially and axially outward in the direction of flow of air with particles entrained therein and which is engaged by the flow of air with particles entrained therein, said deflector having a chamber disposed therein and a porous member which forms an end surface of said deflector through which fluid is conducted from said chamber, said housing assembly at least partially defining an inner central passage which extends from said housing assembly to the chamber in said deflector and through which a flow of fluid is conducted, an electrode arrangement at least partially disposed in said inner central passage, at least a portion of said electrode arrangement being exposed to the flow of air with particles entrained therein to electrostatically charge particles entrained in the flow of air, said housing assembly having surfaces which at least partially define an outer central passage which is disposed in a coaxial relationship with the inner central passage and which extends around and axially along at least a part of said inner central passage and through which the flow of air with particles entrained therein is conducted toward said spray nozzle, said housing assembly including a strut which extends through a portion of the outer central passage and is exposed to the flow of air with particles entrained therein, said housing assembly having surfaces which define a connector passage which communicates with the inner central passage through said strut, a conduit connected with said housing assembly and with a fluid source from which fluid is conducted along a flow path which extends from the conduit to the connector passage, said conduit being connected with said housing assembly at a first location offset outward from said outer central passage and disposed adjacent to a first side of said outer central passage, and an intermediate passage disposed in said housing assembly and extending at least half way around said outer central passage, said intermediate passage extending at least half way around said outer central passage from a first location adjacent to a connection between said conduit and said housing to a second location adjacent to a side of said outer central passage spaced from said first location and adjacent to a connection between said intermediate passage and said connector passage to enable fluid to be conducted from said conduit through said intermediate passage and said connector passage to said inner central passage along a flow path which retards establishment of an electrical arc between said electrode arrangement and a location adjacent to the connection between said conduit and said housing.

19. An apparatus as set forth in claim 18 wherein said portion of said electrode arrangement which is exposed to the flow of air with particles entrained therein is disposed on said deflector and is spaced from said housing assembly.

20. An apparatus as set forth in claim 18 wherein at least a portion of said electrode arrangement is disposed in the chamber in said deflector.

21. An apparatus for directing a flow of air with particles entrained therein toward a workpiece, said apparatus comprising a housing assembly, a spray nozzle connected with said housing assembly to spray the flow of air with particles entrained therein, a deflector connected with said housing assembly, said deflector having an outer side surface which flares radially and axially outward in the direction of flow of air with particles entrained therein and which is engaged by the flow of air with particles entrained therein, said deflector having a chamber disposed therein and a porous member which forms an end surface of said deflector through which fluid is conducted from said chamber, said housing assembly at least partially defining an inner central passage which extends from said housing assembly to the chamber in said deflector and through which a flow of fluid is conducted, an electrode arrangement at least partially disposed in said inner central passage and in said deflector, at least a portion of said electrode arrangement being exposed to the flow of air with particles entrained therein at a location adjacent to a radially and axially outer end of said outer side surface of said deflector and adjacent to said porous member to electrostatically charge particles entrained in the flow of air, at least a portion of said electrode arrangement being exposed to a flow of fluid in said inner central passage, at least a portion of said electrode arrangement being exposed to a flow of fluid in said deflector.

22. An apparatus as set forth in claim 21 wherein a portion of said electrode arrangement is disposed in engagement with an inner side of said porous member and is exposed to a flow of fluid from the chamber in said deflector through said porous member.

23. An apparatus as set forth in claim 22 wherein the portion of said electrode arrangement disposed in engagement with an inner side of said porous member includes a porous electrode sheet having a major side surface disposed in engagement with a major inner side surface of said porous member.

24. An apparatus as set forth in claim 23 wherein the portion of said electrode arrangement which is exposed to the flow of air with particles entrained therein is a peripheral portion of said porous electrode sheet.

* * * * *

UNITED STATES PATENT AND TRADEMARK OFFICE

CERTIFICATE OF CORRECTION

PATENT NO. : 5,582,347

DATED : December 10, 1996

INVENTOR(S) : Alan J. Knobbe, Terrence M. Fulkerson, Curtis B. Haller and John B. Wolanin It is certified that error appears in the above-indentified patent and that said Letters Patent is hereby corrected as shown below:

Column 11, line 6, after "sheet" insert --and--.

Column 11, line 6, after "through" delete --and--.

Column 13, line 40, change "12" to --13--.

Column 13, line 45, change "12" to --13--.

Column 14, line 24, change "12" to --16--.

Signed and Sealed this

Seventeenth Day of June, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,582,347

DATED : December 10, 1996

INVENTOR(S) : Alan J. Knobbe, Terrence M. Fulkerson, Curtis B. Haller and John B. Wolanin It is certified that error appears in the above-indentified patent and that said Letters Patent is hereby corrected as shown below:

Column 15, line 4, after "housing" insert --assembly--.

Column 15, line 12, after "housing" insert --assembly--.

Signed and Sealed this

Second Day of September, 1997

*Attest:*

*Attesting Officer*

BRUCE LEHMAN

*Commissioner of Patents and Trademarks*